US006277024B1

(12) United States Patent
Coulton

(10) Patent No.: US 6,277,024 B1
(45) Date of Patent: Aug. 21, 2001

(54) SECTIONAL ROOF RIDGE VENT

(75) Inventor: Michael S. Coulton, Lansdale, PA (US)

(73) Assignee: Benjamin Obdyke Incorporated, Horsham, PA (US)

( * ) Notice: Subject to any disclaimer, the term of this patent is extended or adjusted under 35 U.S.C. 154(b) by 0 days.

(21) Appl. No.: 09/667,898

(22) Filed: Sep. 22, 2000

(51) Int. Cl.[7] ..... F24F 7/02
(52) U.S. Cl. ..... 454/365; 52/199
(58) Field of Search ..... 454/364, 365; 52/199

(56) References Cited

U.S. PATENT DOCUMENTS

| | | | |
|---|---|---|---|
| 1,717,728 | 6/1929 | Moore . | |
| 2,200,031 | 5/1940 | Lee . | |
| 2,214,183 | 9/1940 | Seymour . | |
| 2,704,500 | 3/1955 | Bonforte . | |
| 2,799,214 | 7/1957 | Roose . | |
| 2,868,104 | 1/1959 | Honholt et al. . | |
| 3,185,070 | 5/1965 | Smith . | |
| 3,236,170 | 2/1966 | Meyer et al. . | |
| 3,311,047 | 3/1967 | Smith et al. . | |
| 3,481,263 | 12/1969 | Belden . | |
| 3,949,657 | 4/1976 | Sells . | |
| 4,280,399 | 7/1981 | Cunning . | |
| 4,325,290 | 4/1982 | Wolfert . | |
| 4,554,862 | 11/1985 | Wolfert . | |
| 4,876,950 | 10/1989 | Rudeen . | |
| 4,903,445 | 2/1990 | Mankowski | 52/199 |
| 4,924,761 | 5/1990 | MacLeod et al. . | |
| 4,957,037 | 9/1990 | Tubbesing et al. . | |
| 4,962,692 | 10/1990 | Shuert . | |
| 5,094,041 | 3/1992 | Kasner et al. | 52/57 |
| 5,095,810 | 3/1992 | Robinson | 454/365 |
| 5,122,095 | 6/1992 | Wolfert | 454/365 |
| 5,167,579 | 12/1992 | Rotter | 454/365 |
| 5,174,076 | 12/1992 | Schiedegger et al. | 52/199 |
| 5,288,269 | 2/1994 | Hansen | 454/365 |
| 5,772,502 | 6/1998 | Smith | 454/365 |
| 6,149,517 * | 11/2000 | Hansen | 454/365 |
| 6,227,963 * | 5/2001 | Headrick | 454/365 |

OTHER PUBLICATIONS

Air Vent Inc., "Filtervent", Informational Brochure, 8 pages, 1987.

Air Vent Inc., Technical Bulletin No. 87–6, "Ridge Filter Shinglevent Development History and Performance Characteristics", 2 pages, Jun. 1987.

Air Vent Inc., Technical Bulletin No. 88–1, "Roll Vent vs. Shinglevent", 2 pages, Jan. 1988.

Air Vent Inc. Announcement of Shinglevent II, 3 pages, Jun. 1990.

* cited by examiner

*Primary Examiner*—Harold Joyce
(74) *Attorney, Agent, or Firm*—Howson and Howson

(57) ABSTRACT

An adjustable-pitch sectional roof ridge vent formed as a one-piece, plastic, injection-molded body having an elongate top wall and a pair of opposed outer sidewalls depending outwardly and downwardly from peripheral longitudinal edges of the top wall. Each of the outer sidewalls has a lowermost edge, a plurality of ventilation openings, and an upturned flange projecting from the lowermost edge. The vent has a pair of opposed, integrally-formed end walls which depend from opposite ends of the top wall and which are each formed by a plurality of separate, spaced apart wall segments extending across the end of the top wall in substantially end-to-end single file alignment. Each pair of adjacent wall segments are spaced apart to form an open gap therebetween to enable ready flexing of the vent, and selected ones of the wall segments have an undulating configuration such that they interconnect to the top wall via a sinusoidal shaped juncture.

20 Claims, 5 Drawing Sheets

10
12
14
18
20
22
24
26
28
30
32
34
36
38
40
42
44
46
48
50
56
62
4
5

SECTIONAL ROOF RIDGE VENT

FIELD OF THE INVENTION

The present invention relates to a roof ridge vent for providing air circulation in a space between the roof and an underlying ceiling structure, and more particularly, the present invention relates to a plastic, injection-molded, sectional roof ridge vent which has an integrally formed, flexible end wall.

BACKGROUND OF THE INVENTION

At least as early as the mid-1980s, sectional roof ridge vents designed to be affixed across an open ridge, or peak, of a roof to provide a path for the circulation of air were commercially available in the United States. Typically, the vents were injection-molded of high density polyethylene in four foot lengths and included an elongate top wall capable of accommodating the pitch of the roof and a pair of opposed outer sidewalls depending from peripheral longitudinal edges of the top wall. Each of the outer sidewalls had a plurality of ventilation openings and an upturned flange functioning as a wind baffle. The vents also included a plurality of brace members for supporting the top wall of the vent a spaced distance from the roof. U.S. Pat. Nos. 5,095,810 and 5,122,095 disclose sectional roof ridge vents similar in construction to those described above.

During installation of the above referenced sectional roof ridge vents, a plurality of the vents are secured end-to-end on the roof ridge longitudinally from one end of the roof ridge to an opposite end of the roof ridge and cap shingles are applied overlying the top walls of the vents. Separately manufactured end plugs are then utilized to close the open ends of the vents at the opposite ends of the roof ridge to prevent the entry of weather, insects, and the like. For example, an end plug made of foam, filter material, or plastic can be applied to close the ends of the vents.

U.S. Pat. No. 5,772,502 issued to Smith and U.S. Pat. No. 4,924,761 issued to MacLeod disclose sectional roof ridge vents having integrally formed end walls. The Smith patent discloses the use of an accordion-pleated end wall having a plurality of pleats sealingly joined in sequence to each other. The Smith patent states that the pleats permit the vent to flex and accommodate varying roof pitches while still maintaining a sealed end wall without any gaps, slots, or holes extending through the end wall. In contrast, the MacLeod patent discloses an end wall formed by a plurality of separate wall sections spaced-apart by open gaps. The spaced apart planar wall segments pivot toward each other and overlap to form a substantially closed end wall when the vent is flexed to accommodate the pitch of a roof.

Other examples of sectional roof ridge vents are provided by U.S. Pat. No. : 1,717,728 issued to Moore; U.S. Pat. No. 2,200,031 issued to Lee; U.S. Pat. No. 2,214,183 issued to Seymour; U.S. Pat. No. 2,704,500 issued to Bonforte; U.S. Pat. No. 2,868,104 issued to Honholt et al.; U.S. Pat. No. 2,799,214 issued to Roose; U.S. Pat. No. 3,185,070 issued to Smith; U.S. Pat. No. 3,236,170 issued to Meyer et al.; U.S. Pat. No. 3,311,047 issued to Smith et al.; U.S. Pat. No. 3,481,263 issued to Belden; U.S. Pat. No. 3,949,657 issued to Sells; U.S. Pat. No. 4,280,399 issued to Cunning; U.S. Pat. No. 4,325,290 and U.S. Pat. No. 4,554,862 issued to Wolfert; U.S. Pat. No. 4,876,950 issued to Rudeen; U.S. Pat. No. 4,903,445 issued to Mankowski; U.S. Pat. No. 4,957,037 issued to Tubbesing et al.; U.S. Pat. No. 4,962,692 issued to Shuert; U.S. Pat. No. 5,094,041 issued to Kasner et al.; U.S. Pat. No. 5,167,579 issued to Rotter; U.S. Pat. No. 5,174,076 issued to Schiedegger et al.; and U.S. Pat. No. 5,288,269 issued to Hansen.

While the sectional roof ridge vents disclosed in the above referenced patents may function satisfactorily under certain circumstances, there is a need for an improved sectional roof ridge vent having an integrally formed end wall which does not require the use of a separately installed end plug and which readily flexes to accommodate a wide range of roof pitches. Preferably, the vent should be capable of ready installation using standard sized 1¾ inch roofing nails fired by standard roofing nail guns. The vent should be adequately reinforced to prevent unwanted compression and should be properly sized to ensure that the standard size nails penetrate to a sufficient depth into the underlying roof deck. In addition, the vents should be capable of endwise mating, should prevent the entry of weather, insects and the like into the ridge opening, and should be capable of cost-efficient manufacture.

OBJECTS OF THE INVENTION

With the foregoing in mind, a primary object of the present invention is to provide an efficient and economical sectional roof ridge vent which is capable of being readily and properly installed in a manner requiring labor skills possessed by the average roof installer.

Another object of the present invention is to provide a sectional roof ridge vent which has a low height profile, which permits use of standard pneumatic roofing nail guns to properly secure the vent to the roof, and which provides an accepted amount of air venting capacity.

A further object of the present invention is to provide a sectional roof ridge vent which has a flexible integral end wall that eliminates the need for a separate end plug and enables use of the vent on roof ridges having steep pitches.

A still further object of the present invention is to provide end walls and support walls which depend from the top wall and resist unwanted compression.

SUMMARY OF THE INVENTION

More specifically, the present invention provides an adjustable-pitch sectional roof ridge vent formed as a one-piece, plastic, injection-molded body having an elongate top wall and a pair of opposed outer sidewalls depending outwardly and downwardly from peripheral longitudinal edges of the top wall. Each of the outer sidewalls has a lowermost edge, a plurality of ventilation openings, and an upturned flange projecting from the lowermost edge. The improvement comprising a pair of opposed end walls which depend from opposite ends of the top wall and which are each formed by a plurality of separate, spaced apart wall segments extending across the end of the top wall in substantially end-to-end single file alignment. Each pair of adjacent wall segments are spaced apart to form an open gap therebetween to enable ready flexing of the vent, and selected ones of the wall segments have an undulating configuration such that they interconnect to the top wall via a sinusoidal shaped juncture.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
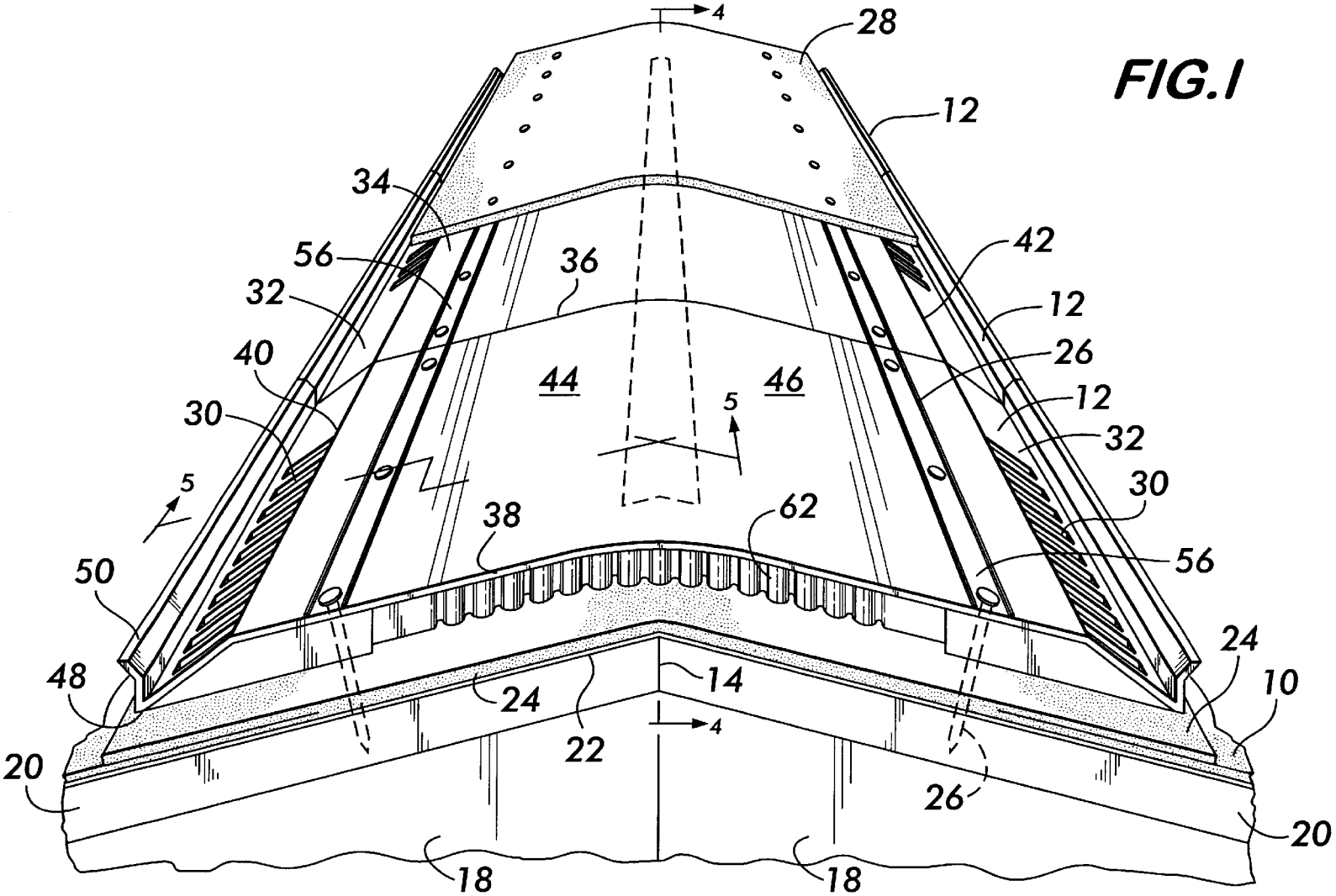
FIG. 1 is a perspective view of a roof ridge having an installed sectional roof ridge vent embodying the present invention.
Figure 4:
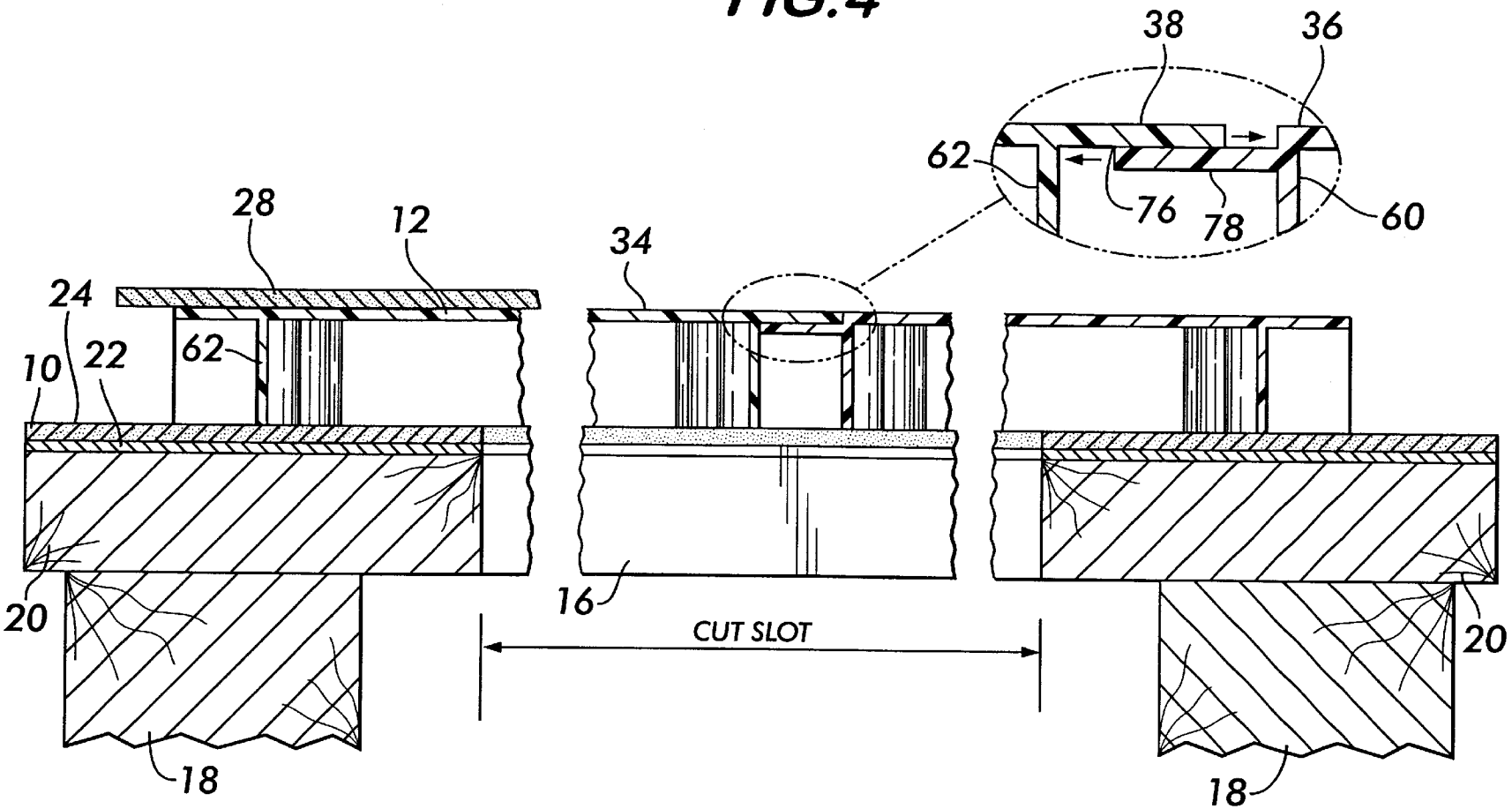
FIG. 4 is a cross-sectional view of the vent of FIG. 1 taken along line 4—4.

Referring now to the drawings, FIG. 1 illustrates a typical roof 10 and a plurality of sectional roof ridge vents 12 applied to the ridge, or peak, 14 of the roof 10. As best illustrated in FIG. 4, a slot-shaped ridge opening 16 is provided continuously along almost the entire length of the roof ridge 14, and the vents 12 are utilized to cover the opening 16 and provide an air ventilation passageway between the underlying attic area and the ambient atmosphere.

The illustrated roof 10 is constructed from a plurality of rafters 18 supported at their lower ends by front and rear walls (not shown) of the building. A roof deck 20, typically constructed of plywood, or other suitable panels, is secured to the rafters 18 to provide an outer sheathing material of the roof 10 over which roofing felt 22 and shingles 24 are applied. Typically, the shingles 24 are secured to the roof deck 20 with nails applied by standard roofing nail guns to finish sloping portions of the roof 10 in accordance with conventional construction practices.

A plurality of sectional roof ridge vents 12 are installed on the roof ridge 14 overlying the slot-shaped opening 16 and portions of the roof deck 20 adjacent to the opening 16. The vents 12 are aligned end-to-end lengthwise across the roof ridge 14 to form an elongate, continuous vent structure extending substantially the full length of the roof ridge 14 and completely overlying the ridge opening 16. Preferably, the vents 12 are secured with standard 1¾ inch roofing nails 26 applied by standard roofing guns. Thereafter, conventional cap shingles 28 can be nailed in overlapping fashion to the sectional roof ridge vents 12 utilizing standard 1¾ inch roofing nails applied by standard roofing guns.

Figure 5:
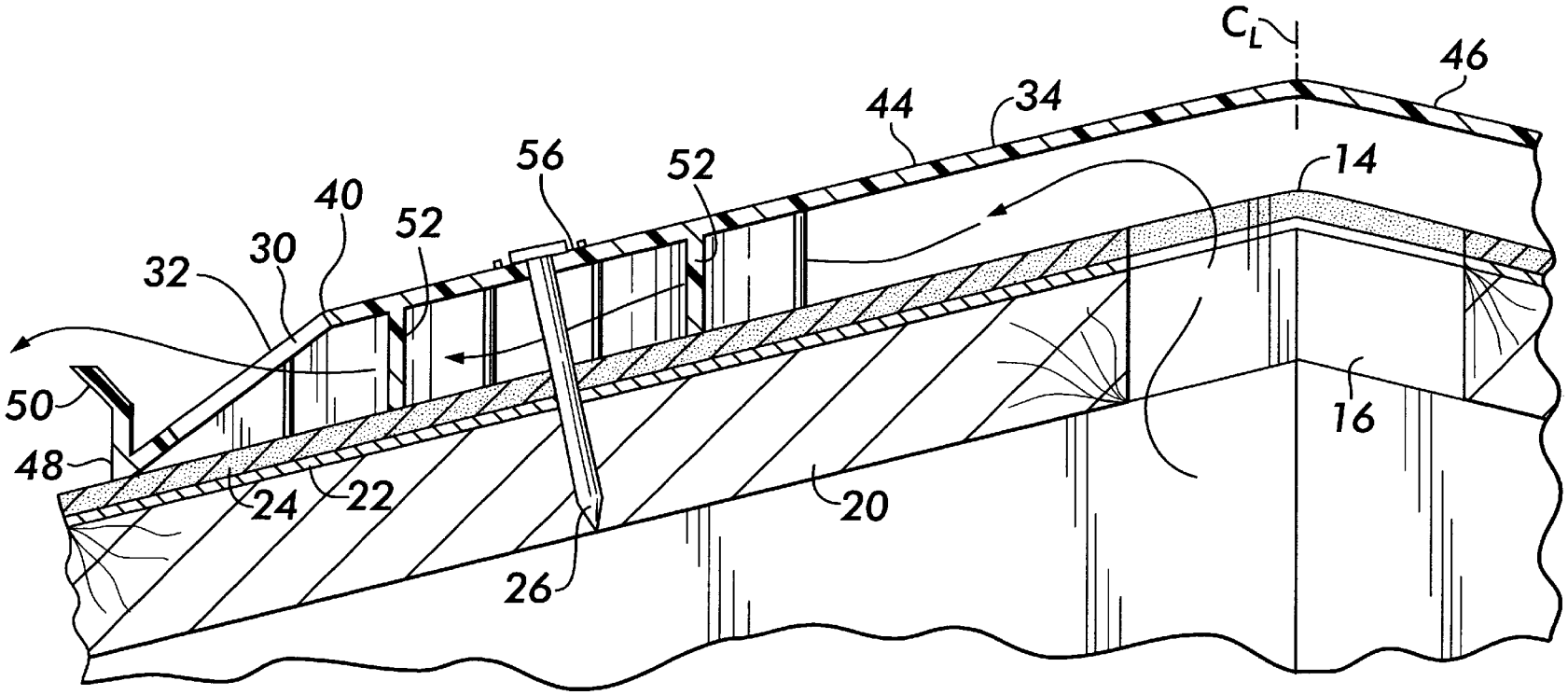
FIG. 5 is a cross-sectional view of the vent of FIG. 1 taken along line 5—5.

As best illustrated in FIG. 5, each vent 12 provides a path of circulation for air exiting the building through the ridge opening 16. To this end, the air is directed laterally between the vent 12 and roof deck 20 and through ventilation openings 30 formed in the sidewalls 32 of the vent 12.

The structure of each sectional roof ridge vent 12 of the present invention includes an elongate top wall 34 and a pair of opposed outer sidewalls 32 similar to those disclosed in previously referenced U.S. Pat. Nos. 5,095,810, 5,122,095 and 5,772,502. To this end, the top wall 34 is substantially rectangular having opposite ends, 36 and 38, and opposite longitudinally-extending side edges, 40 and 42. The top wall 34 has a longitudinal centerline $C_L$ about which the vent 12 bends to accommodate the pitch of the roof 10 adjacent the roof ridge 14. Thus, the centerline $C_L$ defines opposite wings, 44 and 46, of the top wall 34 which are secured to opposite sides of the sloping roof 10 adjacent the ridge opening 16.

The outer sidewalls 32 depend outwardly and downwardly from the peripheral longitudinal edges, 40 and 42, of the top wall 34. Each of the outer sidewalls 32 extends to a lowermost edge 48 which confronts the shingles 22 on the roof deck 20 and includes a plurality of ventilation openings 30 located between the top wall 34 and the lowermost edge 48 of the sidewall 32. In addition, each sidewall 32 includes an upturned flange 50 projecting from the lowermost edge 48. The upturned flange 50 provides a wind baffle and helps to shield the ventilation openings 30 from unwanted wind-blown foreign objects.

One of the novel aspects of the vent 12 of the present invention is the supports, or bracing members, 52 utilized to support and space the top wall 34 from the underlying roof deck 20. To this end, a plurality of spaced-apart, separate support walls 52 depend from the top wall 34 and, as illustrated, are uniformly positioned in four spaced-apart, longitudinally extending rows, $R_1$, $R_2$, $R_3$ and $R_4$. See FIG. 3. Preferably, a pair of the rows, $R_1/R_2$, depend from wing 44 of the top wall 34, and a second pair, $R_3/R_4$, depend from wing 46. Alternatively, additional pairs of rows (not illustrated) of support walls 52 can also be utilized. Each pair of rows, $R_1/R_2$ and $R_3/R_4$, define a nailing area 54 therebetween which is designated on the upper surface of the top wall 34 by an embossed nail line 56. Each nail line 56 extends longitudinally across the top wall 34 and is located between a pair of the rows of support walls 52 so that nails 26 applied through the nail line 56 are free from obstruction from the support walls 52.

Figure 3:
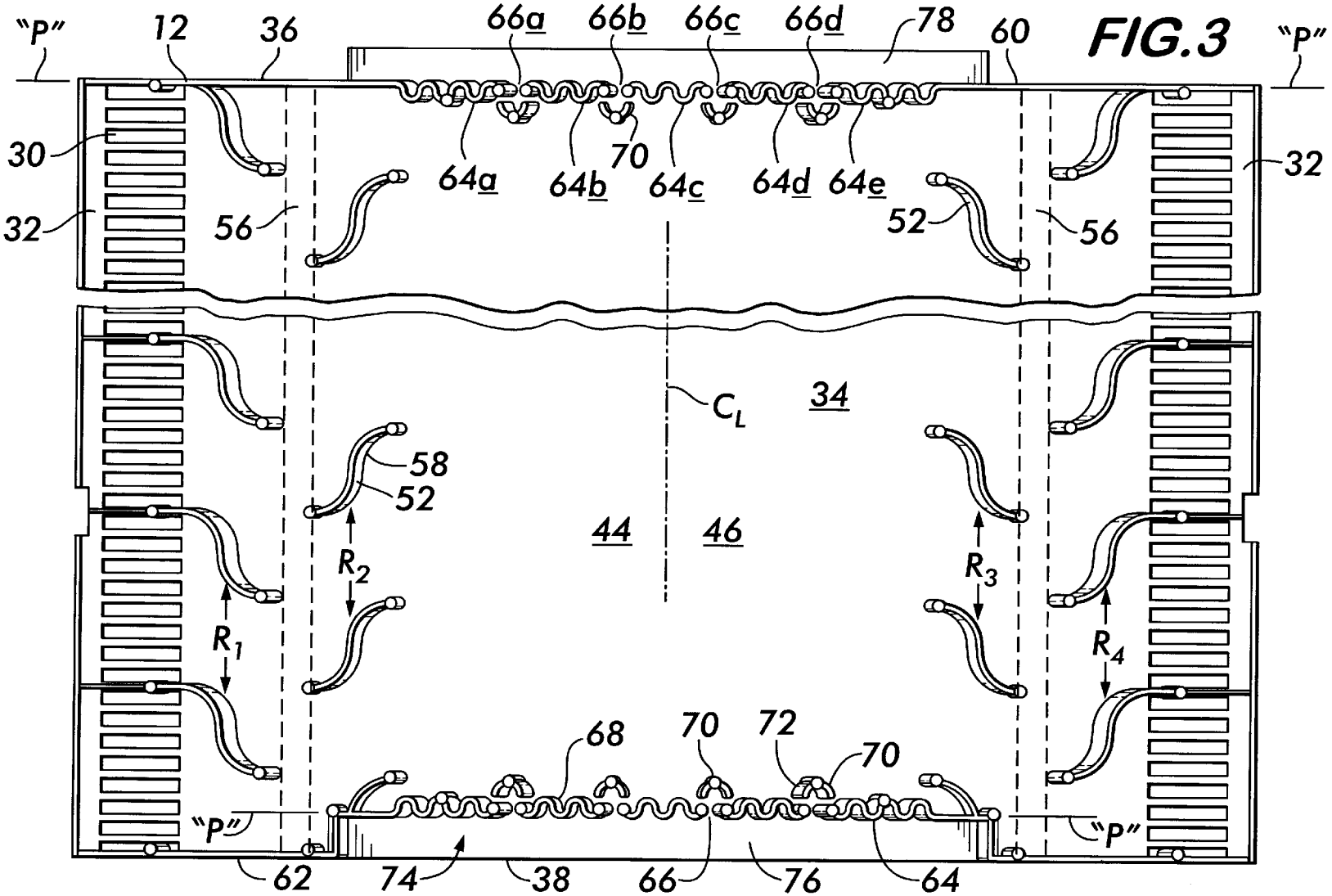
FIG. 3 is a bottom plan view of a length of a sectional roof ridge vent according to the present invention.

As best illustrated in FIG. 3, each support wall 52 has an undulating configuration in transverse cross-section such that it forms a sinusoidal-shaped juncture 58 with the top wall 34. This configuration provides a reinforced support wall 52 which resists unwanted hinging about its juncture 58 to the top wall 34. Thus, the shape of the support walls 52 enhances the top loading strength of the vent 12 and provides resistance against unwanted compression or fracture of the top wall 34 when the vents 12 are installed with nails fired by standard roofing nail guns. In addition, each pair of rows of undulating support walls 52 are offset so that the support walls 52 function as baffles preventing precipitation blown through the ventilation openings 30 from reaching the ridge opening 16. In addition, high loft or non-woven fabrics can be added on the underside of the vent to further enhance prevention of weather infiltration.

Figure 2A:
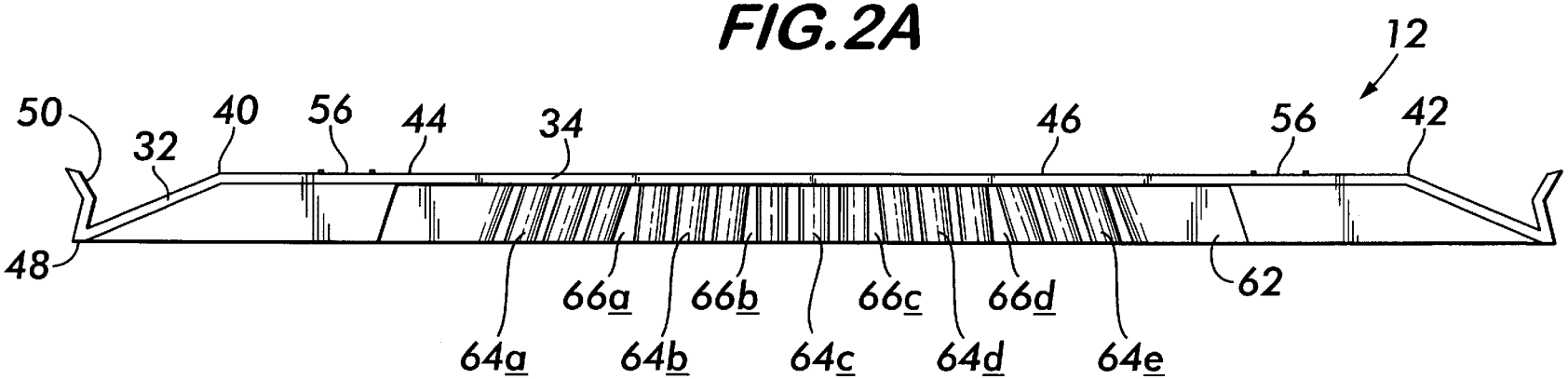
FIG. 2A is an elevational view of an end of the sectional roof ridge vent with its top wall positioned in a planar position.
Figure 2B:
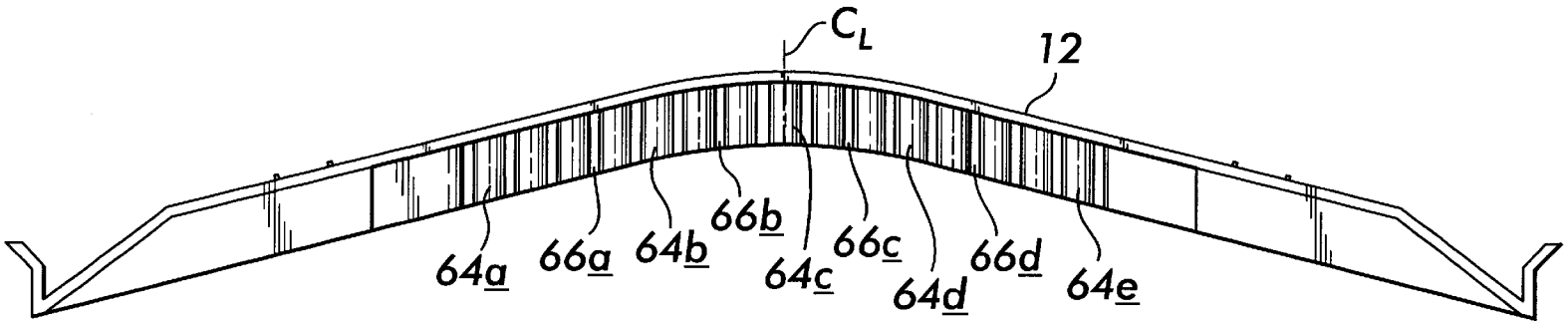
FIG. 2B is an elevational view of an end of the sectional roof ridge vent with its top wall positioned in a roof pitch accommodating position.

Another important aspect of the present invention is the structure of the integrally formed end walls 60 and 62 which permit the top wall 34 to readily flex and conform to the contour of the roof ridge 14 and which eliminate the use of separately installed end plugs. To this end, each of the end walls, 60 and 62, includes a plurality of separate, spaced-apart wall segments 64 depending from the top wall 34 in end-to-end single file alignment across the ends, 36 and 38, of the top wall 34. See FIG. 3. Each adjacent pair of wall segments 64 are spaced apart and form an open gap 66 therebetween to provide the end walls, 60 and 62, with sufficient flexibility. The gaps 66 in each end wall, 60 and 62, are spaced apart and extend in a common imaginary plane "P". Preferably, when said top wall 34 is positioned in a planar position as illustrated in FIG. 2A, the gaps 66 taper outwardly and widen as they extend from the top wall 34 so that, when the top wall 34 is flexed about the roof ridge 14, each pair of adjacent wall segments 64 pivot toward each other and narrow the size of the gap 66 located therebetween.

As illustrated, each end wall, 60 and 62, has five wall segments 64*a*, 64*b*, 64*c*, 64*d* and 64*e*, and four gaps 66*a*, 66*b*, 66cand 66*d*. Preferably, selected portions of the wall segments 64 have an undulating configuration that interconnects to the top wall 34 via a sinusoidal shaped juncture 68. The undulating configuration resists hinging along the juncture 68 and unwanted compression of the top wall 34. In addition, when the vent 12 is installed on a roof ridge 14 of a steeply sloped roof 10, the undulating portions of the wall segments 64 permit adjacent wall segments to engage and become slightly flexed to reduce the size of each opening provided by each gap 66.

A plurality of separate backstop walls 70 are located behind each gap 66 to prevent unwanted entry of wind blown precipitation or debris into the vent 12 through the gaps 66. See FIG. 3. Each backstop wall 70 depends from the top wall 34 and extends a spaced distance behind each open gap 66. Preferably, each of the backstop walls 70 has an arcuate shape in transverse cross-section and forms an arcuate juncture 72 with the top wall 34 to resist compression and ensure blockage of blown precipitation and debris.

In the illustrated embodiment, wall segments 64*b*, 64*c*and 64*d* have an undulating configuration throughout the full extent of the wall segments, while wall segments 64*a* and 64*e* have undulating portions adjacent the gaps, 66*a* and 66*d*, and have opposite planar portions extending to the outer sidewalls 32. In addition, end wall 62 has a central inset portion 74 to provide an area 76 to enable the ends of adjacent vents 12 to mate as illustrated in FIG. 4. To this end, a flange 78 extends outwardly from the top wall 34 adjacent end wall 60 and is received in the area 76 provided by the central inset portion 74 of an end wall 62.

During installation, the first vent 12 is secured to the roof ridge approximately one inch from the end of the roof ridge. The next vent is mated with the first vent and secured to the roof. This process continues until the opposite end of the roof ridge is reached. If the last vent extends beyond the end of the roof ridge, the vent can be cut to an appropriate length and then secured to the roof. To ensure that an integral end wall, 60 and 62, is provided, the end wall structure discussed above can also be provided intermediately on the vent at spaced intervals on the underside of the top wall 34. For instance, an end wall structure can be repeated at one foot intervals so that a four foot vent will have end walls 60 and 62 as well as three intermediate end wall structures (not shown) spaced at one foot intervals on the underside of the vent 12.

By way of example, and not by way of limitation, the vent 12 can be provided in four foot lengths having a width of 14 inches and a height of ⅝ inches. The thickness of the walls of the vent can be 0.07 inches, and the vent can be utilized on pitches of 3/12 to 16/12. Standard 1¾ inch nails can be utilized to provide at least ¾ inch penetration into the roof decking and nail gun compressor pressures of about 90 to 100 psi can be utilized.

The above-described sectional vent according to the present invention provides a roof ridge vent which is easy to install, inexpensive to manufacture, and enables use of standard pneumatic roofing nail guns. Various modifications can be made to the vent such as its size and venting capability.

While a preferred sectional ridge roof vent has been described in detail, various modifications, alterations, and changes may be made without departing from the spirit and scope of the vent according to the present invention as defined in the appended claims.

What is claimed is:

1. An adjustable-pitch sectional roof ridge vent, comprising:

a one-piece, plastic, injection-molded body having an elongate top wall, a pair of opposed outer sidewalls depending outwardly and downwardly from peripheral longitudinal edges of said top wall, and a pair of opposed end walls depending from opposite ends of said top wall, each of said outer sidewalls having a lowermost edge, a plurality of ventilation openings, and an upturned flange projecting from said lowermost edge; and at least one of said end walls being formed by a plurality of separate, spaced apart wall segments depending from said top wall and extending across said end of said top wall in end-to-end single file alignment, each pair of adjacent wall segments being spaced apart to form an open gap therebetween to enable ready flexing of the vent, and at least portions of selected ones of said wall segments having a sinusoidal-shape in transverse cross-section.

2. An adjustable-pitch sectional roof ridge vent according to claim 1, wherein, when said top wall is positioned in a planar position, said open gaps between said wall segments are tapered such that said gaps widen as said wall segments extend from said top wall, and wherein, when said top wall is flexed to accommodate a roof pitch, each pair of adjacent wall segments pivot toward each other and narrow said open gap located therebetween.

3. An adjustable-pitch sectional roof ridge vent according to claim 2, wherein said end wall has at least three gaps and four wall segments, and wherein said gaps in said end wall extend in a common imaginary plane.

4. An adjustable-pitch sectional roof ridge vent according to claim 3, wherein said end wall has four gaps and five segments.

5. An adjustable-pitch sectional roof ridge vent according to claim 2, further comprising a separate backstop wall depending from said top wall a spaced distance behind each open gap, and wherein each of said backstop walls have an arcuate shape in transverse cross-section.

6. An adjustable-pitch sectional roof ridge vent according to claim 3, wherein at least one of said wall segments has opposite ends which lie in said common imaginary plane and an undulating configuration between said opposite ends such that said wall segment interconnects to said top wall via a sinusoidal shaped juncture.

7. An adjustable-pitch sectional roof ridge vent according to claim 6, wherein at least two of said wall segments have opposite ends which lie in said common imaginary plane and an undulating configuration between said opposite ends such that said wall segments interconnect to said top wall via sinusoidal shaped junctures.

8. An adjustable-pitch sectional roof ridge vent according to claim 7, wherein three of said wall segments have opposite ends which lie in said common imaginary plane and an undulating configuration between said opposite ends such that said wall segments interconnect to said top wall via sinusoidal shaped junctures.

9. An adjustable-pitch sectional roof ridge vent according to claim 1, further comprising a plurality of separate undulating support walls depending from said top wall and uniformly positioned in four spaced-apart rows extending longitudinally relative to said top wall.

10. An adjustable-pitch sectional roof ridge vent according to claim 9, further comprising a pair of parallel, spaced-apart, designated nail lines extending longitudinally on said top wall, wherein each designated nail line is sandwiched between two of said rows of undulating support walls so that said nail lines define locations free from obstructions from said rows of undulating support walls and said rows of undulating support walls prevent unwanted compression of said top wall when secured with nails to a roof.

11. An adjustable-pitch sectional roof ridge vent formed as a one-piece, plastic, injection-molded body having an elongate top wall and a pair of opposed outer sidewalls depending outwardly and downwardly from peripheral longitudinal edges of said top wall, each of said outer sidewalls having a lowermost edge, a plurality of ventilation openings, and an upturned flange projecting from said lowermost edge, wherein the improvement comprises:

a pair of opposed end walls depending from opposite ends of said top wall, each end wall being formed by a plurality of separate, spaced apart wall segments depending from said top wall and extending across said end of said top wall in substantially end-to-end single file alignment, each pair of adjacent wall segments being spaced apart to form an open gap therebetween to enable ready flexing of the vent, and at least selected ones of said wall segments having an undulating configuration such that said selected ones of said wall segments interconnect to said top wall via sinusoidal shaped junctures.

12. An adjustable-pitch sectional roof ridge vent according to claim 1, wherein, when said top wall is positioned in a planar position, said open gaps between said wall segments are tapered such that said gaps widen as said wall segments extend from said top wall, and wherein, when said top wall is flexed to accommodate a roof pitch, each pair of adjacent wall segments pivot toward each other and narrow said open gap located therebetween.

13. An adjustable-pitch sectional roof ridge vent according to claim 12, wherein each end wall has at least four gaps and wherein said gaps in each end wall extend in a common imaginary plane.

14. An adjustable-pitch sectional roof ridge vent according to claim 13, further comprising a separate backstop wall depending from said top wall a spaced distance behind each open gap, and wherein each of said backstop walls have an arcuate shape in transverse cross-section.

15. An adjustable-pitch sectional roof ridge vent according to claim 14, wherein at least two of said wall segments have undulating configurations and interconnect to said top wall via sinusoidal shaped junctures.

16. An adjustable-pitch sectional roof ridge vent according to claim 15, wherein three of said wall segments have undulating configurations and interconnect to said top wall via sinusoidal shaped junctures.

17. An adjustable-pitch sectional roof ridge vent according to claim 15, further comprising a plurality of separate undulating support walls depending from said top wall and uniformly positioned in multiple spaced-apart rows extending longitudinally relative to said top wall.

18. An adjustable-pitch sectional roof ridge vent according to claim 17, further comprising a pair of parallel, spaced-apart, designated nail lines extending longitudinally on said top wall, wherein each designated nail line is sandwiched between two of said rows of undulating support walls so that said nail lines define locations free from obstructions from said rows of undulating support walls and said rows of undulating support walls prevent unwanted compression of said top wall when secured with nails to a roof.

19. An adjustable-pitch sectional roof ridge vent according to claim 18, wherein said vent has a height permitting said vent to be nailed to a roof utilizing a standard roofing nail gun with standard 1¾ inch nails.

20. An adjustable-pitch sectional roof ridge vent according to claim 19, wherein said ends of said top wall are designed to mate with ends of an identically structured vent, and wherein a fabric is secured on the vent to enhance prevention of weather infiltration.

* * * * *